US010413142B2

(12) United States Patent
Hwang et al.

(10) Patent No.: US 10,413,142 B2
(45) Date of Patent: Sep. 17, 2019

(54) VACUUM CLEANER

(71) Applicant: LG ELECTRONICS INC., Seoul (KR)

(72) Inventors: Mantae Hwang, Seoul (KR); Jungbae Hwang, Seoul (KR); Philjae Hwang, Seoul (KR)

(73) Assignee: LG ELECTRONICS INC., Seoul (KR)

( * ) Notice: Subject to any disclaimer, the term of this patent is extended or adjusted under 35 U.S.C. 154(b) by 478 days.

(21) Appl. No.: 14/867,445

(22) Filed: Sep. 28, 2015

(65) Prior Publication Data

US 2016/0088987 A1 Mar. 31, 2016

(30) Foreign Application Priority Data

Sep. 26, 2014 (KR) ..... 10-2014-0129595

(51) Int. Cl.

| | |
|---|---|
| ***A47L 9/02*** | (2006.01) |
| ***A47L 5/12*** | (2006.01) |
| ***A47L 9/00*** | (2006.01) |
| ***A47L 5/28*** | (2006.01) |

(52) U.S. Cl.

CPC ..... *A47L 9/0054* (2013.01); *A47L 5/28* (2013.01)

(58) Field of Classification Search

CPC ... A47L 5/12; A47L 5/225; A47L 9/02; A47L 9/04–08

See application file for complete search history.

(56) References Cited

U.S. PATENT DOCUMENTS

| | | | | |
|---|---|---|---|---|
| 3,676,892 | A | 7/1972 | Nordeen | |
| 6,041,472 | A * | 3/2000 | Kasen | A47L 11/4011 15/355 |
| 2003/0145422 | A1* | 8/2003 | Kaffenberger | A47L 9/02 15/377 |
| 2005/0210627 | A1 | 9/2005 | Luebbering et al. | |
| 2008/0040883 | A1* | 2/2008 | Beskow | A47L 5/225 15/329 |
| 2011/0088208 | A1* | 4/2011 | White | A47L 5/28 15/383 |

FOREIGN PATENT DOCUMENTS

| | | |
|---|---|---|
| CN | 1364439 | 8/2002 |
| CN | 101357051 | 2/2009 |

(Continued)

OTHER PUBLICATIONS

Chinese Office Action dated Jun. 2, 2017 issued in Application No. 201510611463.6 (with English Translation).

(Continued)

*Primary Examiner* — Dung Van Nguyen
(74) *Attorney, Agent, or Firm* — Ked & Associates, LLP

(57) ABSTRACT

The vacuum cleaner includes: a vacuum cleaner main body including a suction device generating a suction force; a nozzle assembly connected with the main body and configured to suction air by the suction force of the suction device; a connector configured to connect the nozzle assembly with the main body and rotatably coupled to the nozzle assembly; and a locking unit which locks the main body to maintain a state in which the main body is erect and which unlocks the main body in the locked state by a rotation of the main body.

17 Claims, 8 Drawing Sheets

(56) References Cited

FOREIGN PATENT DOCUMENTS

| | | |
|---|---|---|
| DE | 101 11 867 | 9/2002 |
| JP | 2000-189367 | 7/2000 |
| KR | 10-0331681 | 4/2002 |
| KR | 10-2002-0048866 A | 6/2002 |
| KR | 20-0439834 Y1 | 5/2008 |

OTHER PUBLICATIONS

Korean Office Action dated Aug. 28, 2015 issued in Application No. 10-2014-0129595.
German Office Action dated Jul. 11, 2016 issued in Application No. 10 2015 116 074.9 (English translation attached).

* cited by examiner

VACUUM CLEANER

CROSS-REFERENCE TO RELATED APPLICATION

This application claims priority under 35 U.S.C. § 119 to Korean Application No. 10-2014-0129595, filed in Korea on Sep. 26, 2014, whose entire disclosure is hereby incorporated by reference.

BACKGROUND

1. Field

A vacuum cleaner is disclosed herein.

2. Background

Vacuum cleaners are home appliances that suction air including foreign materials, including dusts, using suction force and discharge air from which the foreign material is removed from a main body to the outside. The vacuum cleaners may be classified into manual vacuum cleaners with which a user directly perform cleaning with a user's own power and automatic vacuum cleaners that perform cleaning by moving themselves by a user's operation.

The manual vacuum cleaners are classified into corded vacuum cleaners connected with power through a cord to perform cleaning and cordless vacuum cleaners cordlessly performing cleaning. These days, the cordless vacuum cleaners are widely used due to inconvenience of cord. The vacuum cleaners may be further classified into a canister type in which a suction nozzle is provided separately from the main body and is connected by a connection tube and an upright type in which the suction nozzle is coupled to the main body.

Recently, hand-held vacuum cleaners in a form of cordless upright vacuum cleaners, stick vacuum cleaners, or hand-held stick vacuum cleaners, formed by a combination of the hand-held type and the stick type, are released due to expansion of residential space, change in a life environment, and more. The cordless vacuum cleaners are configured to have a battery for supplying power to the main body installed therein. So, when the power of the battery is consumed, the battery is charged to perform cleaning.

Korean Patent Application No. 10-2002-0048866 discloses a nozzle for a vacuum cleaner which can effectively clean and access edges and corners or wall niches. In the prior art document, configurations of a nozzle body connecting a nozzle head to the vacuum cleaner and a nozzle for the vacuum cleaner extended through the nozzle body and in which the nozzle head rotates with respect to the nozzle body are disclosed.

Also, in the prior art document, a configuration of a joint part for rotation and a configuration of a connector mounted in the nozzle body, wherein the connector includes a second rotation joint part, are disclosed. A configuration in which the nozzle head is connected with the nozzle body, and the nozzle body is connected with the vacuum cleaner main body by the connector, and a configuration in which the vacuum cleaner main body is rotatable with respect to the nozzle body by the joint part formed in the connector are disclosed. Likewise, a configuration in which the vacuum cleaner main body is rotatable with respect to the nozzle head and the nozzle body by the joint parts and the connector is disclosed.

Although, in the prior art document, a configuration in which the vacuum cleaner main body is vertically rotatable with respect to the nozzle body at various angles by the joint part formed in the connector is disclosed, there is a problem in that the vacuum cleaner main body is not fixed with respect to the nozzle body at a predetermined angle when the joint part formed in the connector is worn out or damaged due to a plurality of rotations.

The above references are incorporated by reference herein where appropriate for appropriate teachings of additional or alternative details, features and/or technical background.

BRIEF DESCRIPTION OF THE DRAWINGS

The embodiments will be described in detail with reference to the following drawings in which like reference numerals refer to like elements wherein.

DETAILED DESCRIPTION

A vacuum cleaner may be provided in various types and forms, but recently a hand-held stick vacuum cleaner, which is a mix of a hand-held type and a stick type, is produced. So, in an embodiment of the present disclosure, a hand-held stick vacuum cleaner with improved use will be described as an example.

Figure 1:
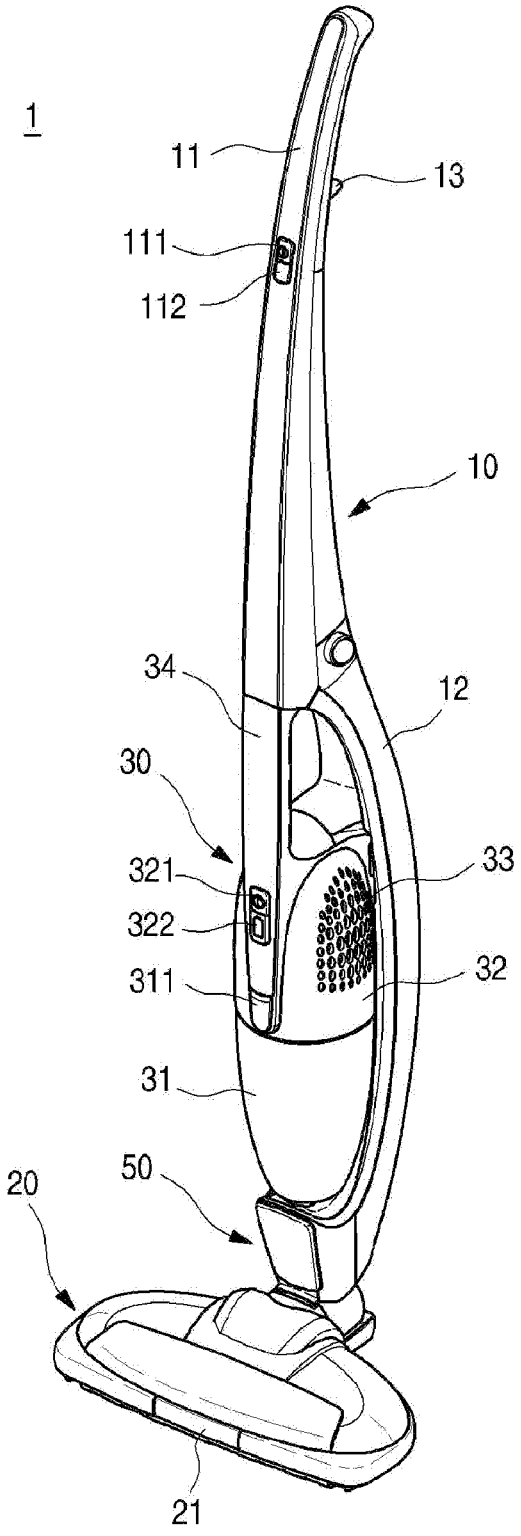
FIG. 1 is a perspective view illustrating a vacuum cleaner according to an embodiment of the present disclosure.

FIG. 1 is a perspective view illustrating a vacuum cleaner according to an embodiment of the present disclosure. The vacuum cleaner 1 may include a vacuum cleaner main body 10 (hereinafter referred to as 'main body') including a suction device generating a suction force, and a nozzle assembly 20 connected with the main body 10 and suctioning air including foreign materials on a surface to be cleaned.

The main body 10 as a whole is formed to be vertically long. A main body handle 11 griped by a user to perform cleaning is formed on an upper end part of the main body 10, and the nozzle assembly 20 may be connected to a lower end part of the main body 10. The main body handle 11 has a finger hold 13 on which a user's finger is held to facilitate the user's grip on the main body handle 11, and a main body power switch 111 allowing the user to select power supply to operate the main body 10.

A main body control switch 112 allowing the user to control the operation level of the main body 10 is further provided on one side of the main body power switch 111. The user's finger is held by the finger hold 13 while the user grips the main body handle 11 so the user may easily move the vacuum cleaner main body 10.

A storing unit 12 in which an auxiliary vacuum cleaner 30 to be described below is separably stored may be formed on a lower part of the main body 10. The storing unit 12 may include a terminal part electrically connecting the auxiliary vacuum cleaner 30 with the main body 10 when the auxiliary vacuum cleaner 30 is stored and mounted in the storing unit 12. The auxiliary vacuum cleaner 30 includes a connection terminal part which comes in contact with the terminal part when the auxiliary vacuum cleaner 30 is mounted in the storing unit 12.

The auxiliary vacuum cleaner 30 is electrically connected with the main body 10 while stored in the storing unit 12, and the inside of the auxiliary vacuum cleaner 30 is configured to be in communication with the main body 10. The auxiliary vacuum cleaner 30 is configured to easily carry out comparatively simple cleaning or a cleaning of a narrow space, and may include a collecting unit 31 collecting foreign materials included in air suctioned through the nozzle assembly 20, a suction device unit 32 in which a suction device generating the suction force by supplied power is mounted, and a battery (not shown) separably mounted to supply power.

The suction device unit 32 includes a suction motor generating power by supplied power, and a suction fan generating the suction force by being rotated by power supplied from the suction motor. An auxiliary power switch 321 to turn the auxiliary vacuum cleaner 30 on/off may be provided in the center of the suction device unit 32. A battery display unit 322 to display a residual quantity of the battery or whether the battery is mounted or not is provided on one side of the auxiliary power switch 321.

Outlets 33 which discharge heat generated in the suction device to the outside while discharging air from which foreign materials are removed to the outside are formed on opposite sides of the suction device unit 32 in forms of a plurality of holes. A filter member to filter the air from which the foreign materials are removed again may be further mounted on the outlets 33.

A separation button 311 to separate the collecting unit 31 is provided on one side of the battery display unit 322. A battery chamber providing a space in which the battery to supply power to the suction device is mounted is formed on one side of the suction device unit 32. Since the battery is separably mounted in the battery chamber, a completely used battery is detached from the auxiliary vacuum cleaner 30, and a charged battery is mounted in the battery chamber to supply power.

An auxiliary suction unit providing a suction passage for air and foreign materials flowing in the nozzle assembly 20 is formed at one end part of the auxiliary vacuum cleaner 30, and an auxiliary handle 34 that a user grips when the user uses the auxiliary vacuum cleaner 30 is provided at the other end portion of the auxiliary vacuum cleaner 30. When the auxiliary vacuum cleaner 30 is stored and mounted in the storing unit 12, the nozzle assembly 20 and the auxiliary suction unit are in communication, so a cleaning of a desired space may be performed by operating the main body 10 in a state in which the auxiliary vacuum cleaner 30 is stored and mounted in the storing unit 12.

The nozzle assembly 20 is rotatably connected with the lower end part of the main body 10 and provides a passage through which foreign materials and ambient air on a surface to be cleaned by a user are suctioned. The nozzle assembly 20 as a whole is formed in a rectangular plate shape having a predetermined inner space, and may suction foreign materials and ambient air together into an inner space. A lower suction unit providing a passage to suction air and foreign materials on a surface to be cleaned together is provided on a lower surface of the nozzle assembly 20, a brush which detaches the foreign materials from the surface to be cleaned while rotating may be rotatably mounted in the nozzle assembly 20.

A light unit 21 is provided to provide a light toward the front of the nozzle assembly 20, that is, in a forward direction in which a user pushes and moves the main body 10. Since the light unit 21 provides a light when the nozzle assembly 20 is moved, a user can recognize foreign materials positioned on a surface to be cleaned even in a dark space. When cleaning is performed in a dark space with the light provided by the light unit 21, since the light is provided, an advantage of being able to prevent the nozzle assembly 20 from being damaged due to shocks can be had.

The light unit 21 is provided in a form of a light-emitting diode (LED), and is controlled to provide the light by allowing the user to operate the main body power switch 111. Of course, the light unit 21 may be provided in a form other than the form of the LED. Regardless of a form of the light unit 21 provided, the light on one surface of the nozzle assembly 20 is provided in the forward direction in which the user pushes and moves the main body 10.

Figure 2:
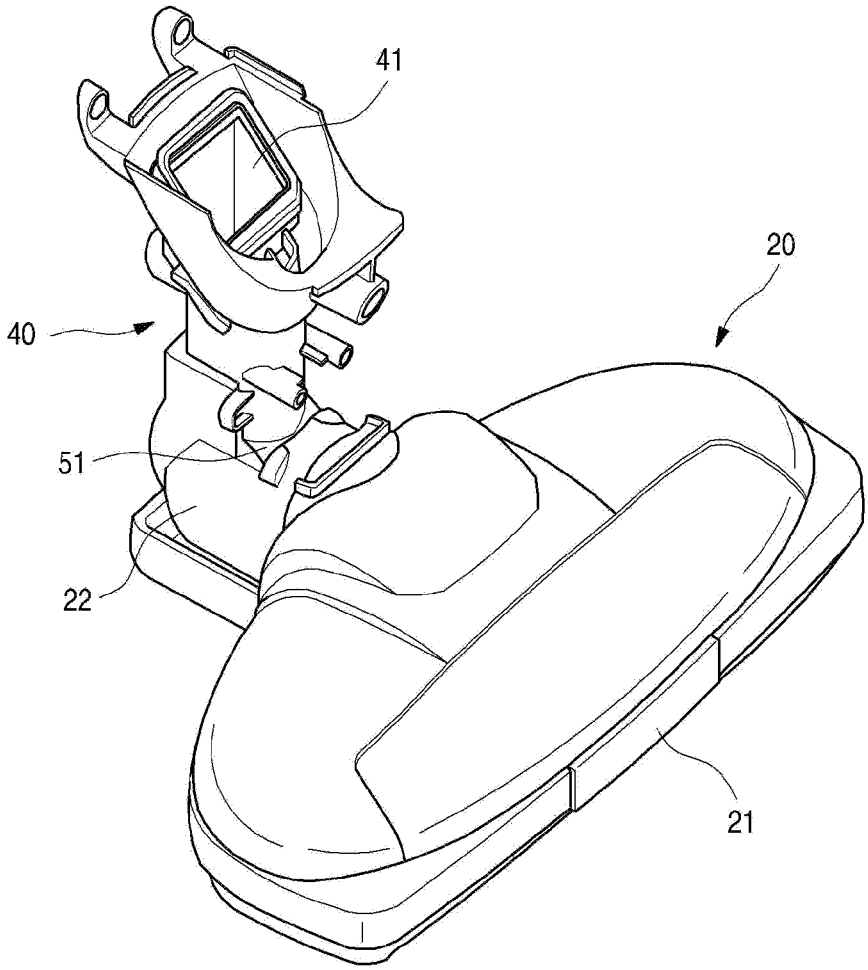
FIG. 2 is a perspective view illustrating a case where a suction nozzle and a connector of the vacuum cleaner according to the embodiment of the present disclosure are locked.
Figure 3:
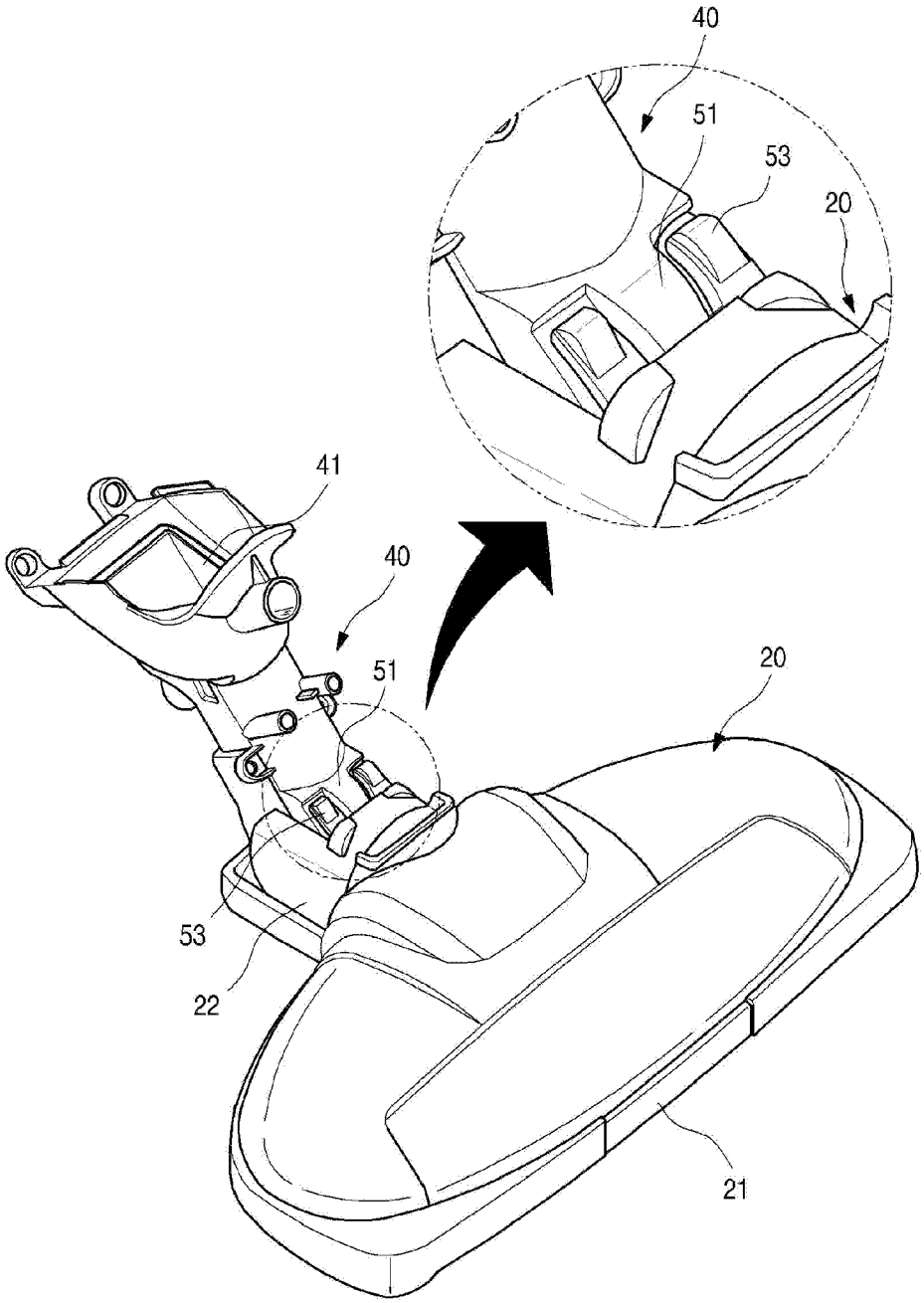
FIG. 3 is a perspective view illustrating a case where the suction nozzle and the connector of the vacuum cleaner according to the embodiment of the present disclosure are unlocked.

FIG. 2 is a perspective view illustrating a case where a suction nozzle and a connector of the vacuum cleaner according to the embodiment of the present disclosure are locked, and FIG. 3 is a perspective view illustrating a case where the suction nozzle and the connector of the vacuum cleaner according to the embodiment of the present disclosure are unlocked.

Referring to FIGS. 2 and 3, a connector 40 for connecting to the nozzle assembly 20 is provided on the lower end part of the main body 10 of the vacuum cleaner according to the embodiment of the present disclosure. It may be possible to have a configuration in which the lower end part of the main body 10 is directly connected to the nozzle assembly 20, at this time a configuration of the connector 40 may be omitted.

The connector 40 as a whole has a vertically long frame shape with a predetermined inner space. An upper end part of the connector 40 is configured to be in communication with the auxiliary suction unit of the auxiliary vacuum cleaner 30, and a lower end part of the connecter 40 is configured to be connected to a rear part of the nozzle assembly 20. An extender 22 for connecting to the connector 40 may be formed at the rear part of the nozzle assembly 20 to be extended rearward. It may be possible to have a configuration in which the nozzle assembly 20 functions as the extender 22 when the extender 22 is not formed.

The upper end part of the connector 40 is formed so that an inside thereof corresponds to a part of an outer surface of the auxiliary suction unit to be connected with a part of a portion where the auxiliary suction unit of the auxiliary vacuum cleaner 30 is positioned. For an example, when viewed in the drawing, a predetermined part of the upper end part of the connector 40 is recessed downward and has a communication hole 41 formed in the center thereof to communicate with the inner space.

When the auxiliary suction unit is in contact with the communication hole 41, the air including foreign materials flowing in the nozzle assembly 20 passes through the communication hole 41 and through the auxiliary suction unit, and the air is collected into the collecting unit 31 of the auxiliary vacuum cleaner 30. A sealing member to prevent air leakage is further provided at an edge portion of the communication hole 41.

The connector 40 is coupled to the extender 22 to be vertically rotatable when viewed in the drawing. Since the lower end part of the connector 40 is coupled to be vertically rotatable with respect to the extender 22, the main body 10 is configured to be vertically rotatable with respect to the nozzle assembly 20 with the lower end part of the connector as the center of the rotation.

The lower end part of the connector 40 has an approximately cylindrical shape when viewed from a side, and upper and lower surfaces are positioned in a lateral direction of the nozzle assembly 20. A center portion of the lower end part of the connector 40 is coupled to the extension part 22 with a fastening member such as a pin and the like. The connector 40 is mounted by the fastening member so that the upper end is vertically rotatable with respect to a connection with the fastening member as the center of rotation.

The vacuum cleaner 1 may further include a locking unit 50. The locking unit 50 may limit a rotation of the main body 10 with respect to the nozzle assembly 20. Therefore, the main body 10 may be maintained to be erect at a predetermined angle. The locking unit 50 may be unlocked by the user. In this case, the main body 10 becomes rotatable with respect to the nozzle assembly 20.

The locking unit 50 includes a limiting unit 51 formed on the connector 40 and limiting a rotation of the connector 40 while being in contact with the nozzle assembly 20, and an elastic member 52 elastically supporting the limiting unit 51. See FIG. 7. The limiting unit 51 may be formed on the connector 40. In this case, the limiting unit 51 is bent and extended outward from a lower end of the connector 40 and has a curved surface in a direction corresponding to a rotation trajectory of the connector 40.

The limiting unit 51 is bent outward from an outer surface of the connector 40, and has a curved surface in a direction corresponding to a rotation trajectory of the connector 40. The limiting unit 51 has a roughly U-shaped cross-section in a state in which the main body 10 is erect at a predetermined angle with respect to the nozzle assembly 20, and an outer surface of the limiting unit 51 has a curved surface in a direction corresponding to a rotation trajectory of the connector 40.

The limiting unit 51 is formed to have a predetermined inner space, and the elastic member 52 is positioned in the inner space to elastically support the limiting unit 51. The limiting unit 51 may be formed in the extender 22, that is, the nozzle assembly 20. That is, a position of the limiting unit 51 is not limited.

When the main body 10 is erect at a predetermined angle with respect to the nozzle assembly 20, the rotation of the connector 40 is limited by the limiting unit 51, and the connector 40 is locked. In the locked state shown in FIG. 6, an end portion of the limiting unit 51 is in contact with the nozzle assembly 20, specifically an inner upper surface of the extender 22, and limits the rotation of the main body 10.

Since the rotation of the connector 40 is limited by the limiting unit 51, the rotation of the connector 40 at a predetermined angle with respect to the extender 22 is limited. As the rotation of the connector 40 is limited, the rotation of the main body is limited, and the main body is locked. For an example, one end part of the connector 40 coupled with the extender 22 is configured so that a rotation is limited by the limiting unit 51 in a state in which the connector 40 is nearly vertical to the extender 22.

When the rotation of the connector 40 with respect to the extension unit 22 is limited, the rotation of the main body 10 with respect to the nozzle assembly 20 is limited, so the vacuum cleaner 1 may be stored in a state in which the main body 10 is fixed when the main body 10 is erect with respect to the nozzle assembly 20. In a state in which the rotation of the connector 40 is limited by the limiting unit 51, that is, in the locked state, when the user rotates the main body 10 to rotate the upper end part of the connector 40 with respect to the lower end part with a force greater than a coupling force of the limiting unit 51, the connector 40 becomes rotatable with respect to the extension unit 22, so the locked state is released.

Referring to FIG. 3, the limiting unit 51 is formed in the connector 40, the rotation of the connector 40 is limited by the limiting unit 51. The limiting unit 51 may further include a fixing protrusion 53 which is partially cut, slits protruding outward, and has a projecting end portion to be caught and coupled with the inner upper surface of the extender 22. For example, the fixing protrusion 53 protruding outward from a partially opened portion of the connector 40 is formed in the limiting unit 51. An upper end part of the fixing protrusion 53 is formed to limit the rotation of the connector 40 while being in contact with the inner upper surface of the extender 22.

It is also possible to have a configuration in which the limiting unit 51 protrudes outward from a part of the connector 40 opened and slit, a configuration in a part of the connector 40 protrudes outward and is caught and coupled with a part of the extender 22, and a configuration in which a protrusion mounted on an outer surface of the connector 40 is caught and coupled with a part of the extender 22.

It will be also possible to have a configuration in which the limiting unit 51 is provided in the extender 22 and a stopper 54 to be described below is formed in the connector 40. Like this, any shape of the limiting unit 51 is allowed, and the shape of the limiting unit 51 is not limited.

However, in the embodiment of the present disclosure, the limiting unit 51 protrudes outward from the connector 40 and is in contact with the inner upper end of the extender 22 to be caught and coupled, so the rotation of the connector 40 may be limited. The elastic member (52 in FIG. 4) to elastically support the limiting unit 51 is further provided in the limiting unit 51. A configuration of the elastic member 52 will be described below.

Figure 4:
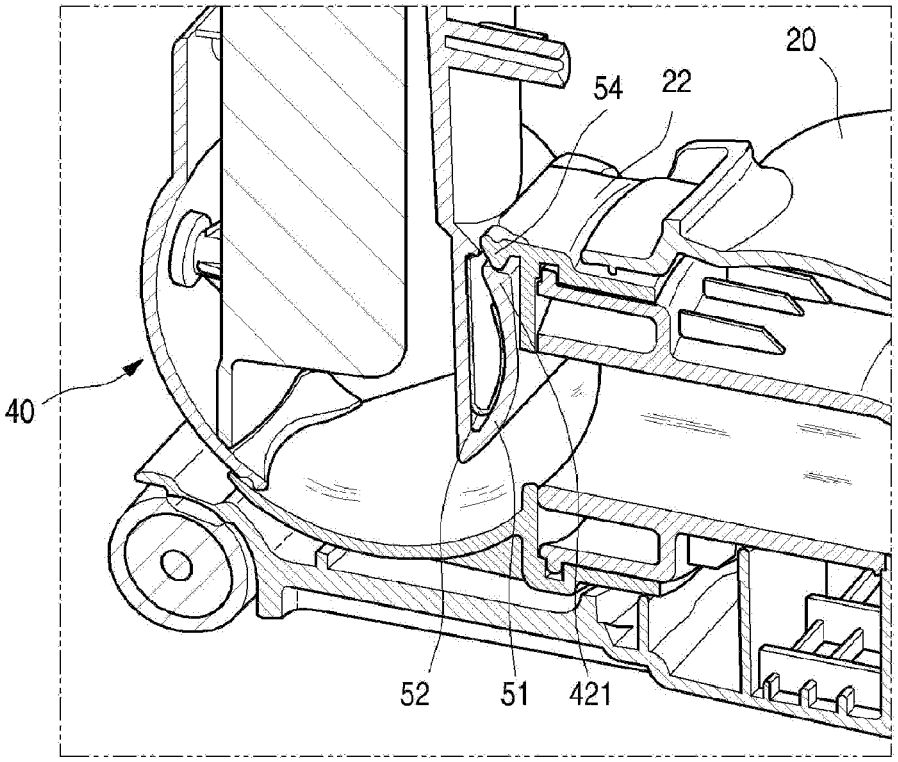
FIG. 4 is a partially cut-away perspective view illustrating an internal configuration in which the suction nozzle and the connector of the vacuum cleaner according to the embodiment of the present disclosure are locked.

A configuration of the connector 40 will be described in detail with reference to FIGS. 4 and 5. FIG. 4 is a partially cut-away perspective view illustrating an internal configuration in which the suction nozzle and the connector of the vacuum cleaner according to the embodiment of the present disclosure are locked, and FIG. 5 is a partially cut-away perspective view illustrating an internal configuration in which the connector is rotated by unlocking the suction nozzle and the connector of the vacuum cleaner according to the embodiment of the present disclosure.

Figure 5:
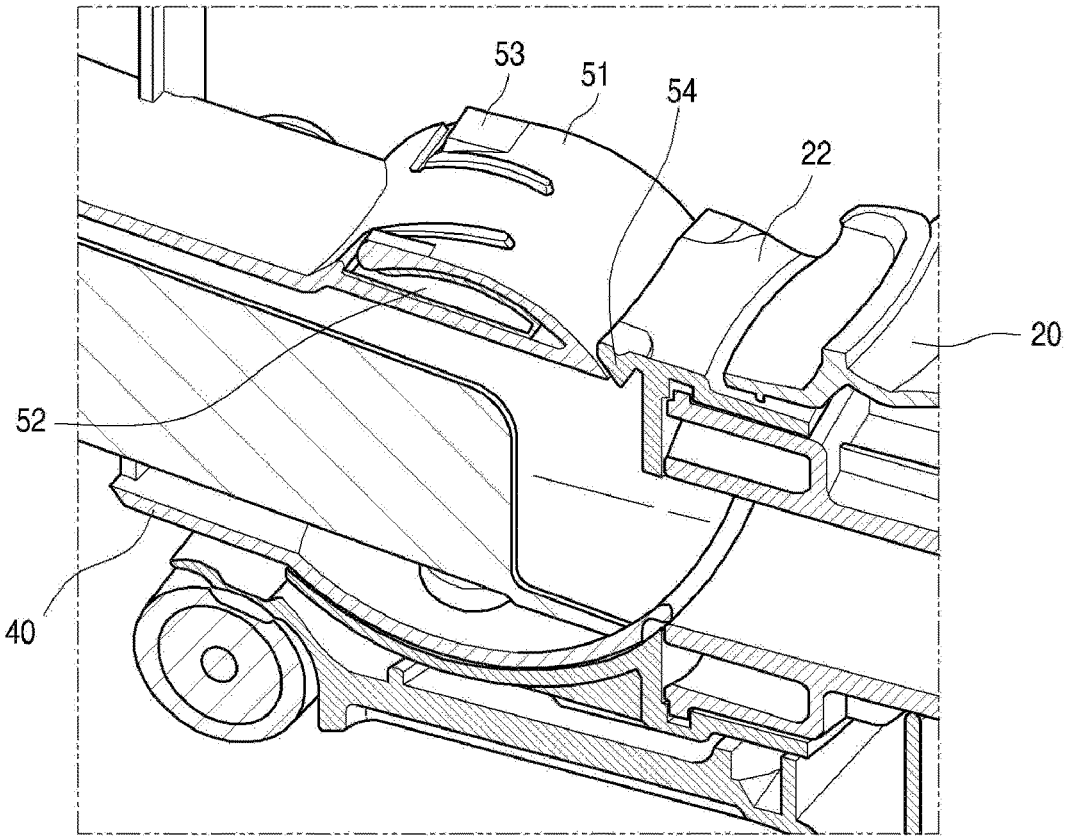
FIG. 5 is a partially cut-away perspective view illustrating an internal configuration in which the connector is rotated by unlocking the suction nozzle and the connector of the vacuum cleaner according to the embodiment of the present disclosure.

Referring to FIGS. 4 and 5, the limiting unit 51 is formed in the connector 40, and the elastic member 52 elastically supporting the limiting unit 51 is provided in an inner space of the limiting unit 51. The elastic member 52 is formed in a leaf spring form to elastically support the limiting unit 51 while inserted into an inner space of the limiting unit 51, and has an open-curve cross-section.

When viewed in FIG. 4, the limiting unit 51 extends from the connector 40 and is formed to have a curvature in a direction corresponding to a trajectory in which the connector 40 rotates. For an example, the limiting unit 51 is extended from one surface of the connector 40 outward and protrudes outward so that the central portion has a predetermined curvature. That is, the limiting unit 51, when viewed in FIG. 4, is formed in an approximately "U" shape, and is elastically supported outward by the elastic member 52. The elastic member 52 is accommodated in an inner space of the limiting unit 51 and has an approximately "U" shape when viewed from a side.

A stopper 54 to limit the rotation of the connector 40 while being in contact with the end portion of the limiting unit 51 is formed in the extender 22. The stopper 54 has a projection protruding toward the limiting unit 51 to press the end portion of the limiting unit 51. Therefore, the end portion of the limiting unit 51 is pressed by the stopper 54 to limit the rotation of the connector 40. When the connector 40 is rotated by a force greater than a force pressing the limiting unit 51, the limiting unit 51 is released from the pressing of the stopper 54, and the connector 40 can be rotated by the release from the pressing the limiting unit 51.

A fixing protrusion 53 to facilitate pressing the limiting unit 51 is further formed at the end portion of the limiting unit 51, specifically, a portion at which the limiting unit 51 is in contact with the stopper 54 and is pressed. The fixing protrusion 53 is formed at the end portion of the limiting unit 51 to expand a contact area with the stopper 54 and facilitate pressing the limiting unit 51.

It may be possible to have a configuration in which the fixing protrusion 53 and the stopper 54 are caught and coupled to each other and a configuration in which the fixing protrusion 53 is formed as a fixing groove 55 (FIG. 7) rather than a protrusion, so the stopper 54 is partially inserted to limit the rotation of the connector 40. Therefore, in the embodiment of the present disclosure, the shapes of the fixing protrusion 53 and the stopper 54 are not limited.

Referring to FIG. 5, the limiting unit 51 is formed so one surface thereof has a curvature with a shape corresponding to a rotation trajectory of the connector 40, and the fixing protrusion 53 protruding outward is formed at the end portion of the limiting unit 51. The elastic member 52 is accommodated in an inner space of the limiting unit 51 to elastically support the limiting unit 51, and the limiting unit 51 is elastically supported outward by the elastic member 52, so the stopper 54 easily presses the fixing protrusion 53.

Figure 6:
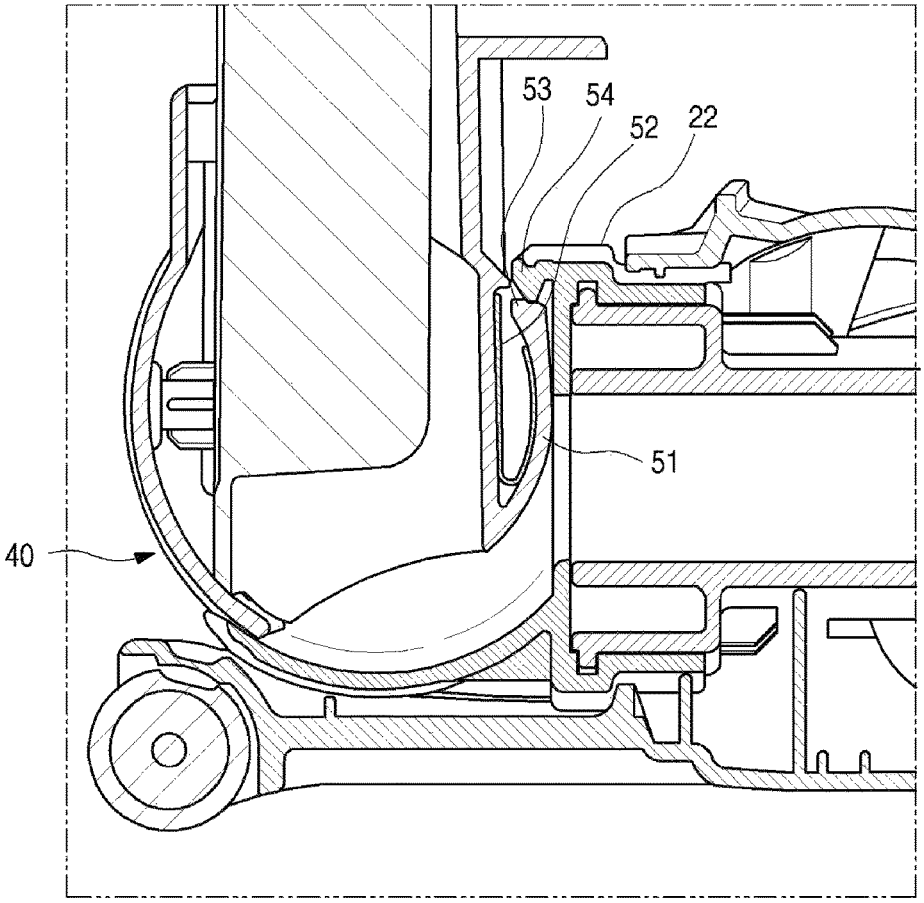
FIG. 6 is a partially cut-away cross-section view illustrating an internal configuration in which the suction nozzle and the connector of the vacuum cleaner according to the embodiment of the present disclosure are locked.
Figure 7:
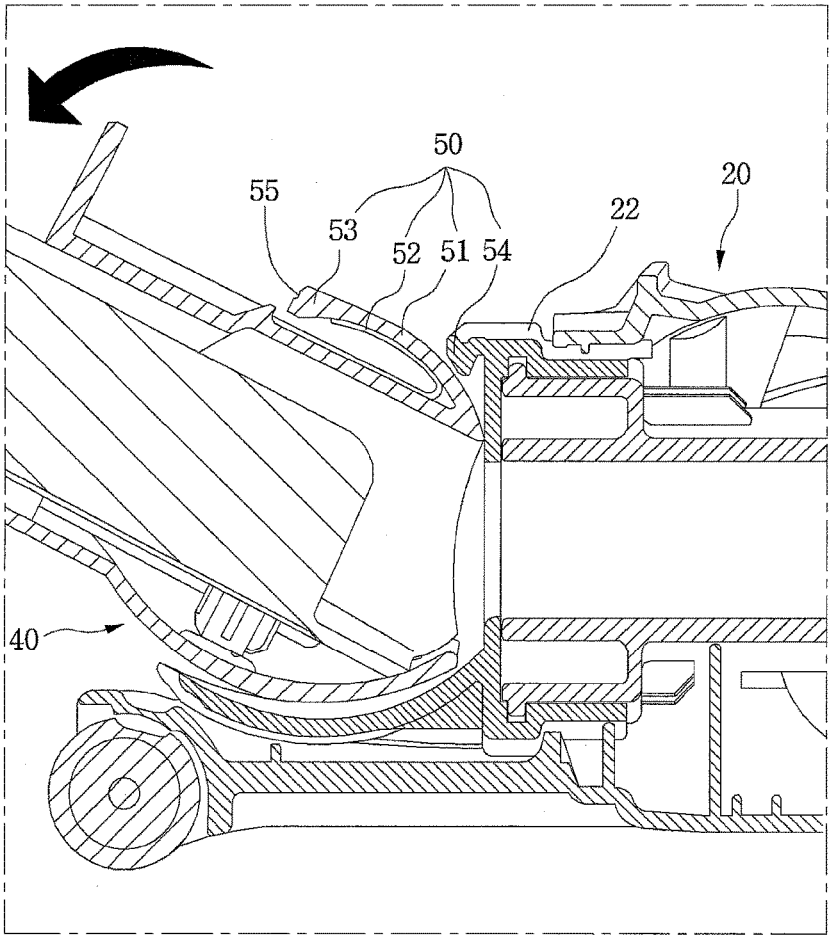
FIG. 7 is a partially cut-away cross-section view illustrating an internal state in which the connector is rotated when the suction nozzle and the connector of the vacuum cleaner according to the embodiment of the present disclosure are unlocked.

The limiting unit 51 and the elastic member 52 according to a rotation of the connector 40 will be described with reference to FIGS. 6 and 8. FIG. 6 is a partially cut-away cross-section view illustrating the inner configuration in which a main body of the vacuum cleaner according to the embodiment of the present disclosure are locked, FIG. 7 is a partially cut-away cross-section view illustrating an internal state in which the connector is rotated when the main body of the vacuum cleaner according to the embodiment of the present disclosure are unlocked, and FIG. 8 is a partially-cut cross-section illustrating the internal state in which the connector is rotated when the main body of the vacuum cleaner according to the embodiment of the present disclosure are unlocked.

Figure 8:
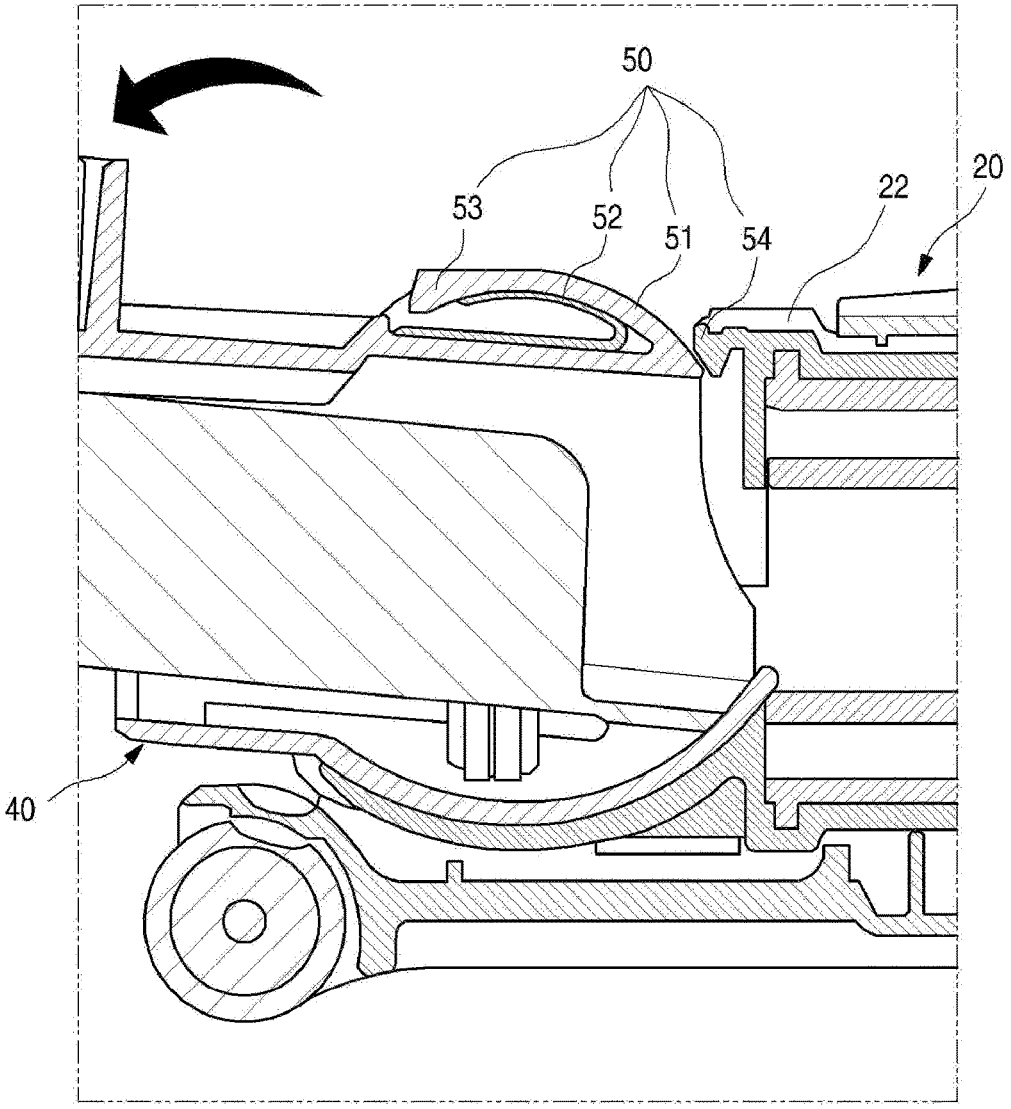
FIG. 8 is a partially cut-away cross-section view illustrating the internal state in which the connector is rotated when the suction nozzle and the connector of the vacuum cleaner according to the embodiment of the present disclosure are unlocked.

Referring to FIGS. 6 and 8, when the main body 10 is locked, the limiting unit 51, while elastically supported outward by the elastic member 52 of the connector 40, is in contact with the stopper 54 and is pressed. When the limiting unit 51 is pressed by the stopper 54, the rotation of the main body 10 is limited, and the main body is locked. When the user rotates the main body with a force greater than the pressing force of the stopper 54 and elastic force of the elastic member 52, the main body 10 is unlocked and rotates like in FIG. 7.

When the limiting unit 51 is released from the pressing of the stopper 54, the main body 10 is unlocked with respect to the nozzle assembly 20 by the rotation of the limiting unit 51 and may rotate with respect to the nozzle assembly 20 at various angles. Specifically, when the limiting unit 51 is unlocked, the connector 40 can be rotated, so the main body 10 is unlocked, and the main body 10 can be rotated with respect to the nozzle assembly 20. When the user rotates the main body 10 near a surface to be cleaned, the connector 40 is in contact with the inner surface of the extender 22 and does not rotate downward any more.

The vacuum cleaner according to the embodiment of the present disclosure that is configured as described above includes the vacuum cleaner main body and a charging stand for charging the main body. Also, the main body includes a detachable battery. The charging stand is configured to include a support unit supporting the main body and a battery charging unit for charging a battery detached from the main body.

The configuration can allow the vacuum cleaner to be easily charged and maximize user convenience.

The present disclosure provides an easy-to-use vacuum cleaner. The present disclosure also provides a vacuum cleaner in which deformation caused by prolonged-use is minimized.

The vacuum cleaner according to the present disclosure includes a vacuum cleaner main body including a suction device generating a suction force; a nozzle assembly connected with the main body and configured to suction air by the suction force of the suction device; a connector configured to connect the nozzle assembly with the main body and rotatably coupled to the nozzle assembly; and a locking unit which locks the main body to maintain a state in which the main body is erect and which unlocks the main body in the locked state by a rotation of the main body.

A vacuum cleaner according to another aspect includes a main body having a suction device to generate a suction force by supplied power; a nozzle assembly rotatably connected with the main body and configured to suction air including foreign materials by the suction force; and a locking unit provided at a connection part of the main body and the nozzle assembly and formed to set a locked state by limiting a rotation in a state in which the main body is erect with respect to the nozzle assembly and to release the locked state by a rotation of the main body.

In the description of embodiments, terms such as first, second, A, B, (a), (b) or the like may be used herein when describing components of the present disclosure. Each of these terminologies is not used to define an essence, order or sequence of a corresponding component but used merely to distinguish the corresponding component from other component(s). It should be noted that if it is described in the specification that one component is "connected," "coupled" or "joined" to another component, the former may be directly "connected," "coupled," and "joined" to the latter or "connected", "coupled", and "joined" to the latter via another component.

Any reference in this specification to "one embodiment," "an embodiment," "example embodiment," etc., means that a particular feature, structure, or characteristic described in connection with the embodiment is included in at least one embodiment of the disclosure. The appearances of such phrases in various places in the specification are not necessarily all referring to the same embodiment. Further, when a particular feature, structure, or characteristic is described in connection with any embodiment, it is submitted that it is within the purview of one skilled in the art to effect such feature, structure, or characteristic in connection with other ones of the embodiments.

Although embodiments have been described with reference to a number of illustrative embodiments thereof, it should be understood that numerous other modifications and embodiments can be devised by those skilled in the art that will fall within the spirit and scope of the principles of this disclosure. More particularly, various variations and modifications are possible in the component parts and/or arrangements of the subject combination arrangement within the scope of the disclosure, the drawings and the appended claims. In addition to variations and modifications in the component parts and/or arrangements, alternative uses will also be apparent to those skilled in the art.

What is claimed is:

1. A vacuum cleaner, comprising:

a main body having an upper end and a lower end, and including a motor generating a suction force;

a nozzle assembly connected with the main body at the lower end and configured to suction air by the suction force;

a connector configured to connect the nozzle assembly with the main body and rotatably coupled to the nozzle assembly; and a lock provided in the connector to lock the main body to maintain a state in which the main body is erect and to unlock the main body from the locked state to allow rotation of the main body relative to the nozzle assembly, wherein the lock includes a limiter formed at the connector and having a portion being in contact with the nozzle assembly to limit a rotation of the connector, and an elastic member configured to elastically support the limiter, wherein the nozzle assembly includes a stopper configured to limit the rotation of the connector by being interlocked with the limiter, wherein the limiter includes a fixing protrusion configured to be in direct contact with the stopper while the main body is in the locked state in which the rotation of the connector is restrained, wherein an upper surface of the fixing protrusion faces the upper end of the main body and is in direct contact with the stopper while the main body is in the locked state, the upper surface being formed to be inclined downward toward the nozzle assembly in the locked state in which the rotation of the connector is restrained, wherein the limiter protrudes outward from a part of the connector, wherein the limiter is formed by cutting a part of the connector to form at least one tab, and wherein an inner space is formed between the limiter and a wall of the connector, and the elastic member is inserted into the inner space.

2. The vacuum cleaner according to claim 1, wherein the elastic member is a leaf spring.

3. The vacuum cleaner according to claim 1, wherein the limiter includes a protrusion having a curvature in a direction corresponding to a trajectory in which the connector rotates.

4. The vacuum cleaner according to claim 1, wherein the lock includes a fixing groove in which at least a part of the stopper is accommodated in the locked state in which the rotation of the connector is limited.

5. The vacuum cleaner according to claim 1, wherein the elastic member has an open curved cross-section contour.

6. The vacuum cleaner according to claim 1, wherein the limiter includes a front surface provided on the front side of the connector and extending vertically along the front side toward the upper end of the connector.

7. The vacuum cleaner according to claim 6, wherein a bottom end of the front surface is attached to the front side of the connector at the lower end, and an upper end of the front surface is provided a prescribed distance from the front side of the connector and configured to move relative to the connector.

8. The vacuum cleaner according to claim 7, wherein the fixing protrusion is formed at the upper end of the front surface of the limiter.

9. The vacuum cleaner according to claim 8, wherein the front surface of the limiter and the fixing protrusion are externally exposed when the main body is in an unlocked state.

10. The vacuum cleaner according to claim 1, wherein a position of the limiter and the elastic member are fixed relative to the main body such that the limiter and the elastic member moves with movement of the main body.

11. A vacuum cleaner comprising:

a main body having an upper end, a lower end and a recess between the upper end and the lower end, a first handle provided at the upper end and a first power switch proximate to the handle;

a connector provided at the lower end of the main body;

a nozzle assembly coupled to the connector; and an auxiliary vacuum cleaner configured to fit in the recess of the main body and configured to be removable from the recess, the auxiliary vacuum cleaner having a nozzle at a first end, a housing with a handle and a second power switch at a second end, and a collection chamber between the nozzle and the housing, a motor and a battery being provided in the housing, wherein the connector includes a locking assembly at a lower end and an inclined communication hole at an upper end, the inclined communication hole being configured to be coupled to the nozzle of the auxiliary vacuum cleaner and the locking assembly configured to lock the main body to an upright state and to unlock the main body to allow rotation of the main body relative to the nozzle assembly, wherein the locking assembly includes a limiter configured to limit a rotation of the main body by being interlocked with the nozzle assembly, and an elastic member configured to elastically support the limiter, wherein the nozzle assembly includes a stopper configured to limit the rotation of the connector by being interlocked with the limiter, wherein the limiter includes a fixing protrusion configured to be in contact with the stopper while the main body is in the locked state in which the rotation of the connector is restrained, and wherein an upper surface of the fixing protrusion faces the upper end of the main body and is in direct contact with the stopper while the main body is in the locked state, the upper surface being formed to be inclined downward toward the nozzle assembly in the locked state in which the rotation of the connector is restrained, wherein the limiter protrudes outward from a part of the connector, wherein the limiter is formed by cutting a part of the connector to form at least one tab, and wherein an inner space is formed between the limiter and a wall of the connector, and the elastic member is inserted into the inner space.

12. The vacuum cleaner according to claim 11, wherein the elastic member is a leaf spring which is inserted into and mounted in the limiter.

13. The vacuum cleaner according to claim 11, wherein the limiter includes a front surface provided on the front side of the connector and extending vertically along the front side toward the upper end of the connector.

14. The vacuum cleaner according to claim 13, wherein a bottom end of the front surface is attached to the front side of the connector at the lower end, and an upper end of the front surface is provided a prescribed distance from the front side of the connector and configured to move relative to the connector.

15. The vacuum cleaner according to claim 14, wherein the fixing protrusion is formed at the upper end of the front surface of the limiter.

16. The vacuum cleaner according to claim 15, wherein the front surface of the limiter and the fixing protrusion are externally exposed when the main body is in an unlocked state.

17. The vacuum cleaner according to claim 11, wherein a position of the limiter and the elastic member are fixed relative to the main body such that the limiter and the elastic member moves with movement of the main body.

* * * * *